United States Patent [19]

Petersen

[11] Patent Number: 5,000,017

[45] Date of Patent: Mar. 19, 1991

[54] APPARATUS FOR TREATING SKINS OR HIDES IN WET PROCESSES

[75] Inventor: Arne Petersen, Hamburg, Fed. Rep. of Germany

[73] Assignee: Johs. Krause GmbH Maschinenfabrik, Hamburg, Fed. Rep. of Germany

[21] Appl. No.: 558,151

[22] Filed: Jul. 13, 1990

Related U.S. Application Data

[63] Continuation of Ser. No. 254,477, Sep. 21, 1988, abandoned.

[51] Int. Cl.[5] ..... C14C 15/00

[52] U.S. Cl. ..... 69/32

[58] Field of Search ..... 69/29, 32, 47; 8/436

[56] References Cited

U.S. PATENT DOCUMENTS

| | | | |
|---|---|---|---|
| 1,363,771 | 12/1920 | Gilardini | 69/29 X |
| 3,872,695 | 3/1975 | Busek | 69/47 |

FOREIGN PATENT DOCUMENTS

| | | | |
|---|---|---|---|
| 328884 | 11/1920 | Fed. Rep. of Germany | 69/29 |
| 3151518 | 7/1983 | Fed. Rep. of Germany | 69/29 |
| 674431 | 11/1964 | Italy | 69/29 |
| 737463 | 6/1980 | U.S.S.R. | 69/32 |

*Primary Examiner*—Wm. Carter Reynolds

*Attorney, Agent, or Firm*—Antonelli, Terry, Stout & Kraus

[57] ABSTRACT

An apparatus for treating hides or skins with liquids in so-called wet processes, e.g. tanning, drenching, dyeing, etc., includes a liquid-impermeable substrate receiving the hide in inflexible manner and a treatment device tightly applicable to the top of the hide by which the treatment liquid penetrates the hide under pressure. For limiting the operating pressure in the range of approximately 10 bar, and for the effective penetration of the treatment liquids, the treatment device has several juxtaposed liquid supply ducts arranged roughly at right angles to the substrate, which are widened in large-area manner on the underside of the device facing the hide and are arranged thereon in surface-filling manner. Between the underside of the treatment device and the hide is arranged a fine-mesh support and the gap between the substrate, hide, support and treatment device can be substantially tightly sealed to the outside.

16 Claims, 4 Drawing Sheets

APPARATUS FOR TREATING SKINS OR HIDES IN WET PROCESSES

This is a continuation of application Ser. No. 254,477, filed Sept. 21, 1988, now abandoned.

BACKGROUND OF THE INVENTION

The invention relates to an apparatus for treating skins or hides with liquids in so-called wet processes, e.g. liming, drenching, tanning, dyeing or the like, comprising a liquid-impermeable substrate inflexibly receiving the hide and a treatment device substantially tightly applicable to the top of the hIde by means of which the treatment liquid penetrates the skin under high pressure.

In leather processing the term wet processes is used for the treatment stages in which the skin or hide is treated with dissolved chemicals and where there is a high liquid requirement This includes the soaking of the skin, liming in a strong alkaline solution, deliming (neutralizing) in an acid solution, drenching, e.g. by means of proteolytic enzymes, pickling by means of acids and salts, tanning, e.g. by means of chromium-III-salts, retanning and dubbing the hide, as well as dyeing. Most of these wet processes in conventional tanneries take place in vat-like containers, accompanied by multiple circulation and for varyingly long action times, large liquid quantities being required and are constantly circulated.

These tannery wet processes are technically unsatisfactory for several reasons. The hide must pass through a plurality of process stages, which in part take place batchwise with a hide weight of up to 20 tons, but in part in individual form. This requires several times the dividing up of the batches, individualizing and orientation of the hides, e g. alignment or orientation on the basis of the head and butt, which is correspondingly time and labour-consuming. Large hides or skins can have a surface area up to 6 $m^2$ and can weigh up to 100 kg, as a function of the water content. As transportation must take place manually over considerable distances within the tannery, a correspondingly large labour requirement exists. As a result of the corrosive chemicals and the organic substance emanating from the hide, it is scarcely possible to bringabout hygienic working conditions for personnel. There is in particular the problem of getting rid of large waste water quantities, particularly as the treatment liquids can only be reused to a very limited extent.

Dyeing processes have been improved somewhat (German patent 822 060), in that the hides are placed on a belt and led part a dye spraying device, which makes it possible to at least reduce the difficulties during the handling of the hide. However, here again, the need for dyeing liquid is considerable, because it is sprayed at a distance onto the hide, so that a large amount of dyeing liquid does not reach the hide and consequently a considerable action time is required to ensure that the dyeing liquid penetrates the hide. In this way, thorough dyeing is either impossible, or requires a considerable amount of time. In the other aforementioned wet processes, the treatment liquid must intensely and completely penetrate the hide, so that it must be in constant contact with the treatment liquid for a long time. In order that in said wet processes it is possible to have a planned working with minimum liquid requirement, it has been proposed (EP-OS 0 009 081), to introduce the treatment liquid into the skin under high pressure in the manner of an injection process.

In this injection process it is possible to work with highly concentrated treatment liquids, so that the water requirement is much lower than in conventional tannery processes. Only a comparatively small treatment liquid excess has to be used, which must merely ensure that the entire thickness of the hide is penetrated by the treatment liquid. This process is carried out by means of injection nozzles similar to injection guns, which can be placed on the hide and by means of which the treatment liquid can be forced under a high pressure of more than 50 bar into the hide. Within the actual hide, the treatment liquid is spread out in roughly circular manner over a somewhat larger area. In order to treat a hide in this way, a large number of such injection nozzles is required. Tests over many years with this process have not led to satisfactory results. There are many reasons for this. Thus, difficulties are encountered in injecting the treatment liquid in uniform manner over the entire skin surface and cross-section. Thus, besides thoroughly tanned areas, there are inadequately tanned areas. The different thickness of the hide also leads to problems. The treatment liquid pressure level must be designed for the greatest hide thicknesses, i.e. for example in the neck and back regions, so that in the thin skin regions the treatment liquid is shot through the skin and cannot therefore have its desired action. Finally, skin damage can occur as a result of the high pressures, particularly in the vicinity of the injection nozzle attachment. Thus, this process only permits a waste-free operation from the flesh side of the hide. However, even here the hide must be left for a certain time to enable the treatment liquid forced in in jet-like manner to completely penetrate. This lateral penetration then varies very considerably as a function of the hide thickness.

It is finally impossible with acceptable equipment and general costs to treat a complete hide in a single operation. Thus, in the aforementioned apparatus (EP-OS 0 009 081), the hide is moved in synchronized manner passed two successively arranged and reciprocally displaced nozzle rows, so that it is only zonally treated. The injection pressure is absorbed by the inflexible support, which presses !he hide against the injection nozzles.

The problem of the present invention is to so improve the aforementioned apparatus that, with reduced operating pressure, a uniform penetration of the treatment liquids into the skin or hide is ensured.

According to the invention this problem is solved in that the treatment device has several liquid supply ducts arranged approximately perpendicular to the substrate and which on the underside of the device facing the hide are widened in large-area manner and are arranged in surface-filling manner thereon and that between the underside of the device and the hide is provided a net-like support and the gap between the substrate, hide, support and treatment device is substantially tightly sealable with respect to the outside. In the inventive apparatus, in the vicinity of their opening, the supply ducts have a comparatively large-area extended or widened portion of e.g. several $cm^2$, said widened portions having a geometrical contour and an arrangement such that they are closely linked with one another and cover a large-surface area. In order that the treatment liquid entering the widened portions through the supply ducts is injected into the skin in uniform manner over the widened portion cross-section, the net-like support is provided on the hide, which on the one hand levels the hide somewhat in said area and on the other ensures a punctiform penetration of the treatment liquid over a large cross-section. In order to avoid a pressure drop to the outside the gap provided between the substrate, the hide, the support and the treatment device is tightly sealable to the outside. This is generally made possible in that the parts are moved correspondingly tight together, without separate edge-side seals being required.

Practical tests with the aforementioned apparatus have revealed a number of advantages. Thus, it is possible to work with much lower pressures than proposed by the prior art. An adequate, large-area penetration is ensured at a pressure of about 10 bar. As a result and through the large-area action, skin or hide damage is completely prevented. As a function of the nature of the wet process, the treatment liquids can be injected from the flesh or grain side. The treatment device can also have a large area, so that a complete hide can be treated in a single operation, so that the action time and overall treatment period can be considerably reduced. Due to the large-area action of the treatment liquid and the lower operating pressure, it is ensured that the treatment liquid effectively penetrates independently of the hide thickness and is distributed throughout the hide. "Shooting through" cannot occur, particularly in thin hide areas. This is also aided by the fact that, unlike in high pressure injection nozzles, the low pressure of approximately 10 bar can be maintained for a longer period in the widened portions and therefore on the hide The large-area widened portions of the supply ducts on the underside of the treatment device can have a polygonal or circular contour, in whose centre issues at least one supply duct in each case. The widened portions can e.g. have a contour in the form of equilateral triangles, squares, polygons or circles.

As is known per se, also in the case of the inventive apparatus it is possible to provide a net-like intermediate layer between the hide and the substrate, to permit the draining off of the treatment liquids penetrating the hide. However, as such an intermediate layer would be too flexible in order to receive and withstand the treatment pressure at the other side, it is also necessary to provide an inflexible substrate, which then has several juxtaposed drains for the treatment liquid penetrating the skin. The excess treatment liquid penetrating the skin or hide consequently passes through the fine-mesh intermediate layer to the inflexible substrate, where it is led away through the drains.

In a preferred embodiment of the invention the net-like support and intermediate layer are formed by a fine-mesh plastic or metal net, which on the one hand has the necessary flexibility for adapting to unevenesses of the hide and on the other hand has the necessary strength to resist the operating pressure, without the mesh width changing under the action of the operating pressure. It is admittedly known (German patent 822 060) to use metal nets as a substrate for hides, in order to permit a draining of the treatment liquid (dyeing liquid), whilst it is also known to use such metal nets during the pressing of water out of the hides. However, in the present invention the metal net fulfils another function, namely in that it forms a support for the hide, which uniformly distributes the treatment liquid supplied from the outside and allows it to penetrate the hide in punctiform manner.

According to another embodiment the underside of the treatment device or the widened or extended portions arranged there in surface-filling manner can, in one extension direction, have an extension corresponding to the hide width or length. In this case the treatment liquids are injected stripwise into the skin, which is in turn moved intermittently through the apparatus.

However, according to a preferred embodiment, the underside of the treatment device or the extended portions of the supply ducts arranged there in surface-filling manner cover a surface roughly corresponding to the surface of a hide. This embodiment makes it possible to treat a complete hide in one operation, so that a high throughput can be achieved.

According to another embodiment the support and intermediate layer receiving the hide between them are constructed as conveyor belts. Thus, the hide can be placed between the two conveyor belts and conveyed between them into the apparatus, so that the necessary manual activities for the complete treatment are restricted to placing the hide on the entry to the conveyor belts and removing the hide at the exit therefrom. Optionally the hide can be ejected at the exit from the conveyor belts.

According to another development of the invention the substrate is constructed as a table and can be raised against the treatment device. In this case the skin is introduced by means of the metal nets constructed as conveyor belts between the substrate and the treatment device, the table is then raised against the latter, accompanied by the simultaneous pressing of intermediate layer, hide and support against the treatment device and accompanied by tight sealing against the outside, after which the treatment liquid can be supplied by means of the supply ducts.

Another embodiment is inventively characterized in that the substrate is constructed as a revolving link belt, between whose links the treatment liquid can drain off. In this case the link belt forms an adequately inflexible support for the hide, which is here again conveyed between the fine-mesh intermediate layer and a support.

In this embodiment, the link belt can be guided in trough-like manner in the vicinity of the treatment device and the underside of the latter can be curved so as to fill the trough. In this embodiment the hide is conveyed between the support and the intermediate layer into the trough between the treatment device and the link belt and can be treated intermittently, or advantageously continuously.

In the case of a continuous treatment, it is appropriate if the treatment device is constructed as a revolving cylinder, on whose circumference are arranged the widened portions of the supply ducts, which are controllable in their opening position only in the vicinity of the trough. In this embodiment with a treatment device concomitantly rotating with the link belt, there is no relative movement between the hide and the treatment device, i.e. despite the continuous operation, it is ensured that the widened portions on the underside of the treatment device always remain in the same relative position with respect to the hide, so that the action time of the treatment liquid is exclusively controllable by the conveying speed through the trough gap. In this way, movement through the treatment device can take place with juxtaposed hides.

According to another development of the invention with the fine-mesh support and intermediate layer is associated outside the treatment device at least one cleaning device, e.g. a spraying device, by means of which it is possible to eliminate any contaminants or dirt which has deposited between the meshes and which come from the skin. The spraying device can be operated with compressed water or air. This ensures that in particular the fine-mesh support has free mesh cross-sections prior to each entry into the apparatus, so as to permit a completely satisfactory distribution of the treatment liquids.

The inventive apparatus is also characterized by a collecting container penetrating the hide and receiving excess treatment liquid and from which the latter can be recirculated. As the inventive apparatus gives the possibility to work with highly concentrated treatment liquids and during the actual treatment said liquids undergo no or only minimum changes to their composition, the excess treatment liquid can be reused. Optionally a purely mechanical treatment, e.g. the filtering of the treatment liquid is sufficient, to enable it to be resupplied to the treatment device. It is only necessary to quantitatively compensate the losses resulting from the penetration of the hide, Large waste water quantities are not produced, because it is only necessary to eliminate that treatment liquid, which can no longer be reused for chemical and/or physical reasons. This is constituted by extremely small quantities with known constituents, which can easily be dealt with by the waste disposal system.

According to another advantageous development with the treatment device is associated a large-volume pressure vessel for the treatment liquids, which on the one hand is provided with the collecting container and on the other with a feedline for the fresh treatment liquid. By means of the pressure vessel, e.g. an air chamber, an identical pressure can be maintained in easy manner for all the supply ducts. The pressure vessel is on the one hand supplied from the collecting container with the recirculated treatment liquid and on the other hand, for compensating the liquid remaining in the skin and any other liquid which may be lost, with fresh treatment liquid. Instead the treatment device can be directly supplied by pumps.

It is finally appropriate if chemical-physical sensors are arranged in the collecting container or pressure vessel enabling the feedline to be controlled for fresh treatment liquid in order to maintain given concentrations in the pressure vessel. This makes it possible to achieve a completely automated sequence of wet processes in the tannery.

BRIEF DESCRIPTION OF THE DRAWINGS

The invention is described in greater detail hereinafter relative to embodiments and the attached drawings, show.

DETAILED DESCRIPTION

Figure 1:
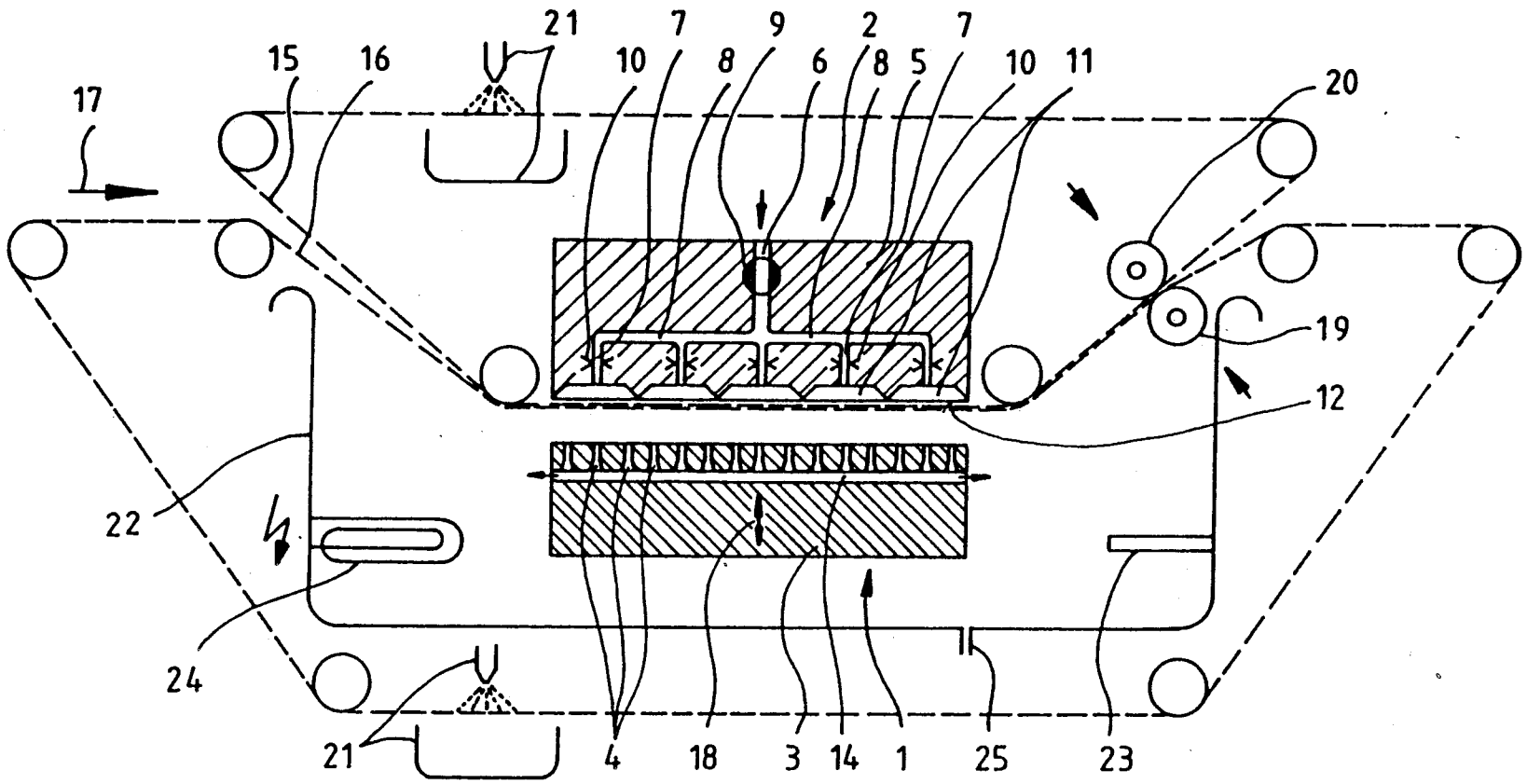
FIG. 1 is a diagrammatic view of a first embodiment of the apparatus.

The apparatus according to FIG. 1 has as its essential components a substrate generally designated by the reference numeral 1 and a treatment device generally designated by the reference numeral 2 located above it, whereby the substrate 1 is constructed as a type of table 3 in a rigid, inflexible form. The top of the table 3 has several drains 4 for the treatment liquid.

The treatment device 2 comprises a pressure tight casing 5 with a central supply duct 6 and several supply ducts 7 connected thereto, which are approximately at right angles to the surface of table 3 and are successively arranged in juxtaposed manner in parallel rows. The supplied ducts are connected by a distribution line 8 to the central supply line 6 equipped with a valve 9 for closing or blocking off the entire treatment device 2. In addition, each individual supply duct 7 has a shutoff valve 10 and the supply ducts 7 issue into widened or extended portions 11, which have a large area compared with the duct cross-section and which are positioned open on the underside 12 of treatment device 2.

Figure 2:
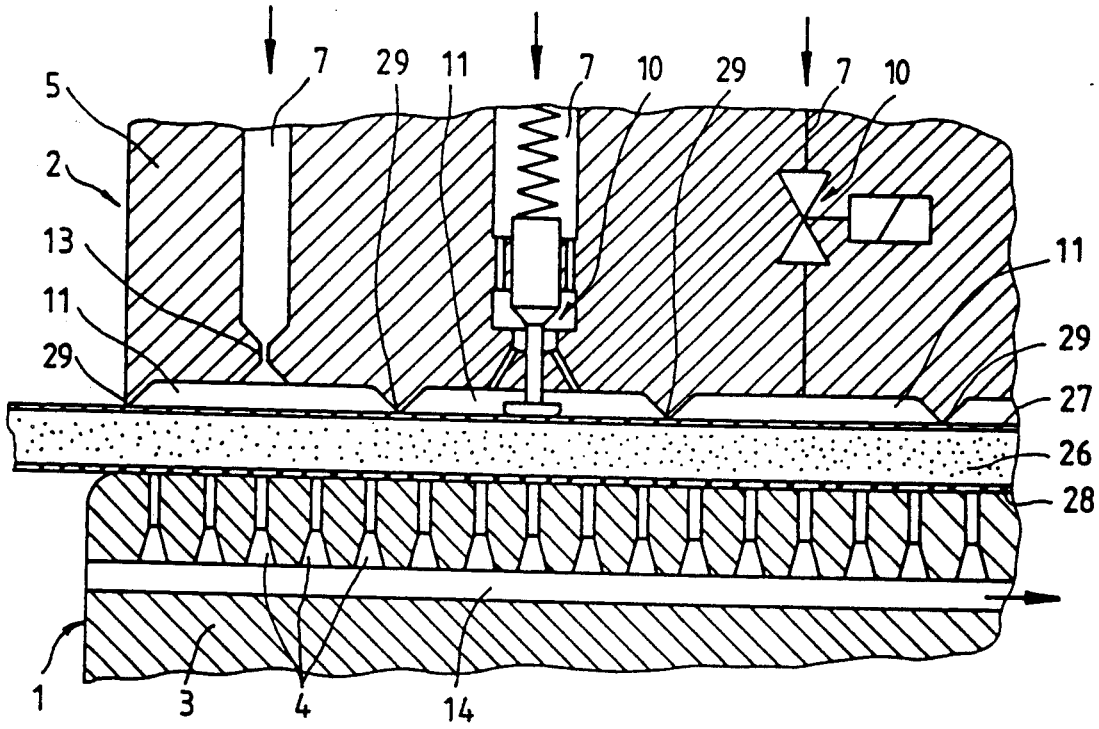
FIG. 2 is a broken away, larger-scale partial view of the treatment device and substrate.

As can in particular be gathered from FIG. 2, the valves 10 in supply ducts 7 can be differently constructed, e.g. they can be mechanically operated piston-type valves 13, as shown in the central construction, or can be electromagnetic valves 13*a*. In place of the valves 10, each supply duct 7 need only have a single diaphragm $13^s$ and then only the central shutoff valve 9 in the central supply line 6 ensures the connecting in and out.

In the central construction the piston-type valve 13 has on an extension a ram 13", which serves to cover part of the subsequently described support 27, if e.g. there is no hide below it, so that an excessively fast pressure drop at this point is avoided and liquid consumption is kept as low as possible.

As can also be gathered from FIG. 2, drains 4 on the top surface of the table-like substrate 3 can be connected to a central drain passage 14.

In the embodiment of FIGS. 1 and 2, an endless upper belt 15 and an endless lower belt 16 pass between the table-like substrate 1 and the treatment device 2 between which is placed the hide an being loaded between the belts 15, 16 at a position designated by the arrow 17. The upper and lower belts 15,16 are guided by several guide pulleys and, in each case at least one driving pulley. At least the upper belt 15 comprises a fine-mesh metal net and serves as a hide support in the vicinity of treatment device 2. The lower belt 16 can also be a fine-mesh metal net, but can also be a different permeable belt.

The skin or hide loaded at the 17, position is introduced between upper belt 15 and lower belt 16 between the table-like substrate 1 and the treatment device 2 and is brought into position by stopping the belts 15, 16. The construction is such that the upper belt 15 is located directly below the underside 12 of the treatment device 2 and also bounds towards the bottom the widened portions 11 of supply ducts 7. The gap between substrate 1 and treatment device 2 is then closed and sealed to the outside, in that, in this embodiment, the substrate 1 can be moved in the direction of arrow 18, e.g. by pressure cylinders, and thereby acts against the lower belt 16 serving as an intermediate layer in the vicinity of the treatment device 2, the hide placed thereon and the support-forming upper belt 15 in such a way that they are tightly pressed against the treatment device 2. Subsequently the treatment liquid is supplied via the central supply duct 6 or valves 10 are opened. Following an adequate action time during which the excess treatment liquid penetrating the skin or hide 26 is removed by the drains 4 and passage 14 (FIG. 2), the table-like substrate 1 is lowered, belts 15,16 are moved on by at least one hide length and simultaneously the next hide is introduced into the apparatus.

Behind the treatment device 2 a squeezing gap is formed by two rollers 19,20, where the excess treatment liquid leading to the soaking of the skin or 26 hide is squeezed out. Finally, the upper belt 15 and the lower belt 16 pass in each case one spraying device 21 enabling any contaminants to be removed from the meshes of the belts 15,16.

The excess treatment liquid falling onto the table-like substrate 1 and is led away by a passage 14, as well as the treatment liquid squeezed out between squeezing rollers 19,20 pass into a collecting container 22, which in the embodiment according to FIG. 1 is constructed in the form of a tub. The tub can be equipped with chemical-physical sensors 23, e.g. pH-meters, so that it is possible to obtain chemical-physical information on the excess treatment liquid and the extent of its reusability. The tub-like collecting container 22 can also be equipped with a mechanism 24, in order to ensure a certain treatment liquid temperature. The excess treatment liquid can be recirculated by a drain 25.

FIG. 2 makes it clear that the hide or skin 26 located between support 27 (upper belt 15) and intermediate layer 28 (lower belt 16), which can both be constructed as fine-mesh metal nets, after moving the table 3 against the treatment device 2 is secured between them. The sealing to the outside can take place by external warp and/or weft wires of the metal net. The reciprocal sealing of the individual widened portions 11 takes place in such a way that small-area webs 29 are formed between the widened 11 portions and which, in the operating position according to FIG. 2 also press against support 27 and, consequently, at least substantially prevent a passage of treatment liquid from one widened portion 11 into an adjacent portion.

Figure 3A:
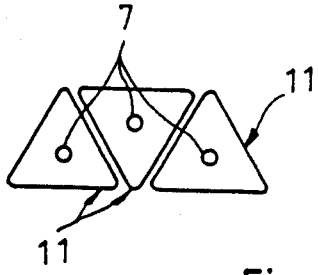
FIGS. 3*a*–3*d* are views of the different embodiments of the widened portions of the supply ducts and their reciprocal arrangement.
Figure 3C:
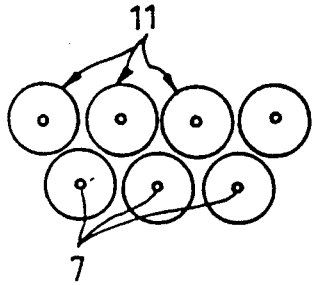
Figure 3B:
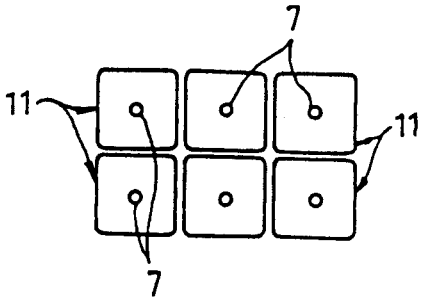
Figure 3D:
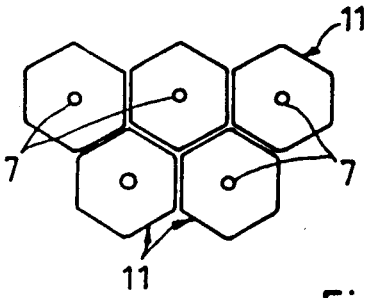

The widened portions 11 are arranged in surface-filling manner on the underside 12 of treatment device 2 (FIG. 1). Various embodiments and arrangements for the widened portion are shown in FIGS. 3*a*–3*d*. In the embodiment according to FIG. 3*a*, the widened portions generally designated by the reference numeral 11*a* have a contour in the form of equilateral triangles, into whose center issue the supply ducts 7. FIG. 3*b* shows widened portions generally designated by the ref. 11*b* with a square contour and centrally issuing supply ducts 7, while FIG. 3*c* shows widened portions generally designated by the reference numeral 11*c* with a circular contour and supply ducts 7 terminating at the centre thereof. Finally, the widened portions generally designated by the reference numeral 11*d* in the embodiment according to FIG. 3*d* are constructed as polygons, namely in the form of regular hexagons. Instead of a single supply duct 7, naturally several ducts can issue at each widened portion 11, 11*a*, 11*b*, 11*c*, 11*d* and a symmetrical arrangement with respect to the outline of the widened portion is favourable.

Figure 4:
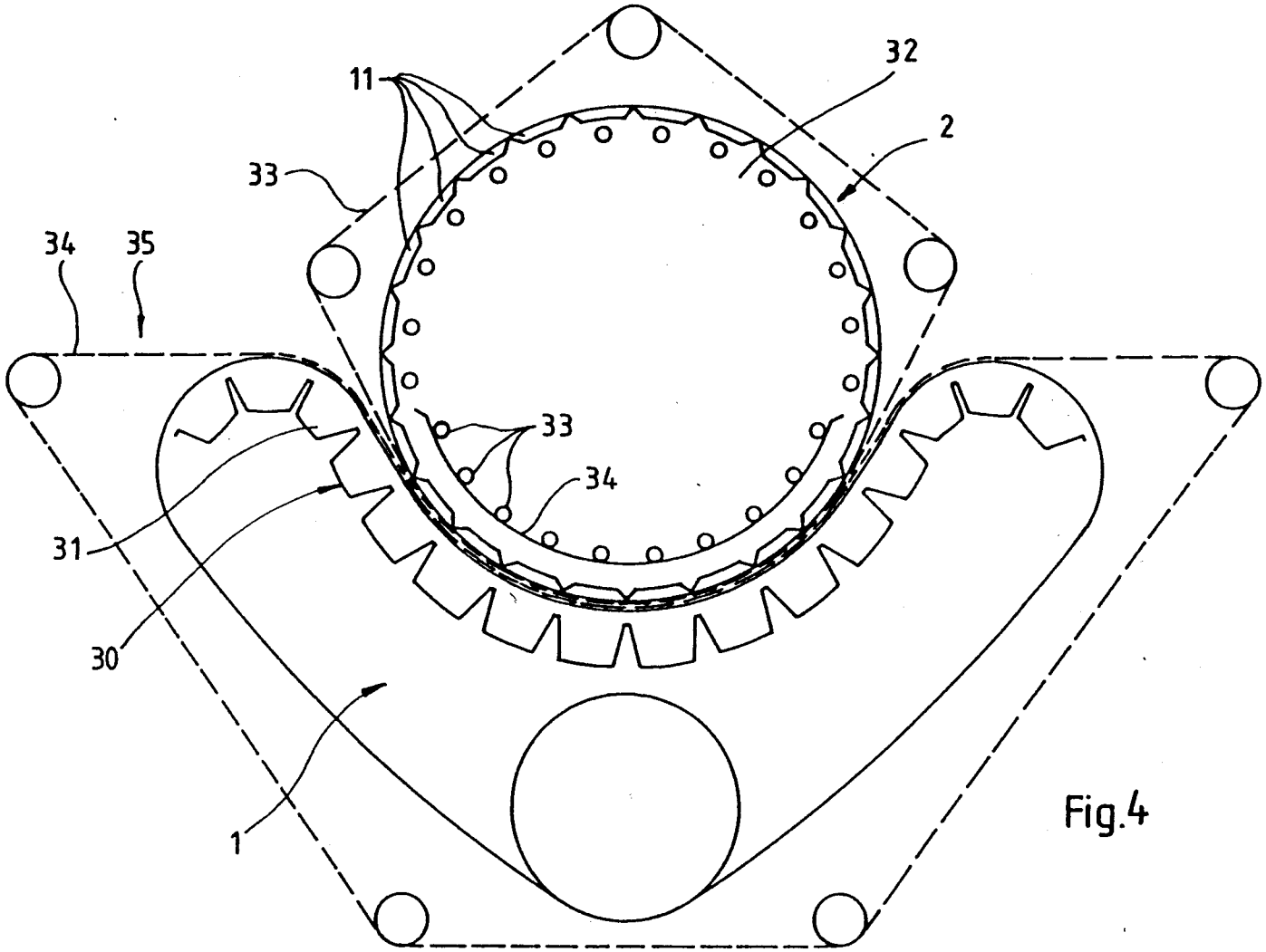
FIG. 4 a diagrammatic view of a second embodiment of the apparatus.

A different construction of the apparatus is shown in FIG. 4, where the table-like substrate 1' comprises a link belt 30, which is guided by guide pulleys in such a way that upper strand 31 can be deformed in trough-like manner. Between the individual links of the link belt 30 are formed drainage gaps, through which the excess treatment liquid can drain away.

Above link belt 30 is arranged the treatment device 2' in the form of a circular cylinder 32, which is provided over its entire circumference with widened portions 11*e* of not shown supply ducts. The treatment liquid can be supplied by means of a central feed into cylinder 32 and can be supplied to the widened portions 11*e* by means of corresponding radial supply ducts. Each of the supply ducts has a shutoff valve, which is opened and closed by means of an actuator 33. For this purpose a control cam 34' is provided, which is only located on the path of the rotary cylinder 32 covered by link belt 30. In this path portion in which the upper strand 31 of link belt 30 is deflected downwards in trough-like manner, the hide is treated.

Here again there is a support formed by an upper belt 336, as well as a lower belt 34. Between upper belt 33 and lower belt 34 the hide is loaded at 35 and conveyed in the gap between the treatment device 2 and the link belt 30. Through synchronous revolution of the treatment device 2 and the link belt 30, it is possible to ensure that the widened portions 11, where the treatment liquid is under pressure, always face the same point of the skin.

Figure 5:
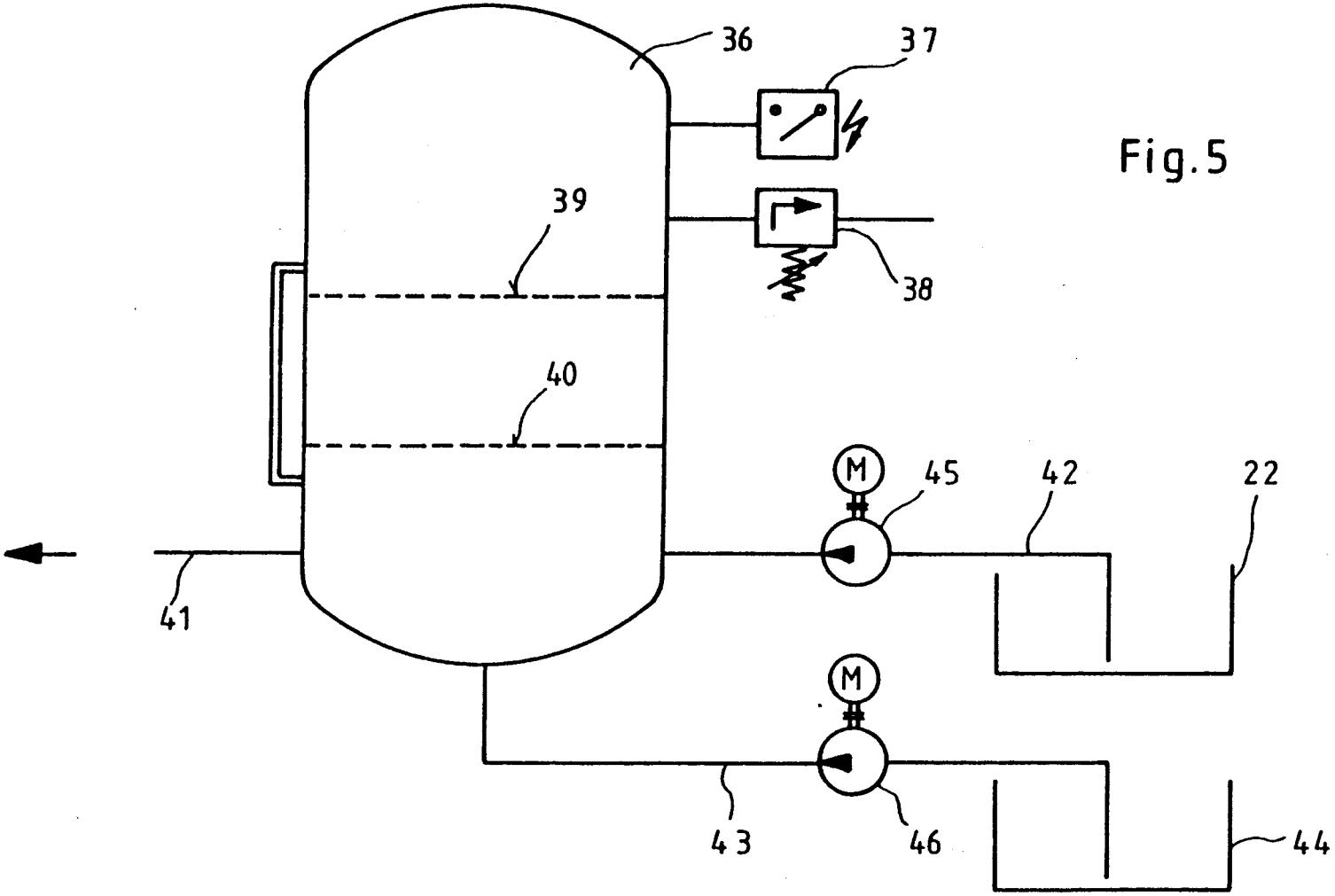
FIG. 5 is a diagrammatic flow chart of a supply device for the treatment device.

FIG. 5 shows part of the supply mechanism for the treatment device in the form of a flow chart. It has an air chamber 36 as a supply vessel for the treatment liquid, which is equipped with a pressure transducer 37 and a safety valve 38. The treatment liquid level in the air chamber 36 is controlled between a maximum level 39 and a minimum level 40. Air chamber 36 is connected by means of a supply line 41 to the treatment device 2 and also, via a supply line 42, to the collecting container 22, as well as, via a further feedline 43, to a storage vessel 44, which contains fresh treatment liquid. Pumps 45 and 46 are placed in feedlines 42,43. Treatment liquid losses are compensated by feedline 43, as are any concentration fluctuations, while feedline 42 carries the recirculatable treatment liquid from collecting container 22.

I claim:

1. Apparatus for treating skins or hides with liquids in wet processes, the apparatus comprising a liquid permeable substrate support inflexibly receiving the hide and a treatment device adapted to be substantially tightly applied to the top of the hide and including a plurality of liquid supply ducts arranged approximately perpendicular to the substrate support, each of said plurality of liquid supply ducts terminating on an underside of the treatment device facing the hide with a widened cross-sectional area larger than a cross-sectional area of the respective liquid supply ducts, said widened cross-sectional areas being arranged in close proximity to each other and separated by a narrow web portion so as to enable a filling of substantially an entire surface of the skin whereby the treatment liquid penetrates the skin under high pressure, wherein a net-like support is provided between the underside of the treatment device and the skin, a net-like intermediate layer is provided between the skin and the substrate support, a gap between the substrate support, skin, net-like support and treatment device is substantially tightly sealable with respect to the outside, and wherein valving means are provided in each of the supply ducts for controlling a flow of the treatment liquid to the widened cross-sectional areas so as to enable the high pressure penetration of the skin by the treatment liquid.

2. Apparatus according to claim 1, wherein the widened cross-sectional areas of the supply ducts have, on the underside of the treatment device, a polygonal contour, and wherein at least one supply duct issues from a center of the contour.

3. Apparatus according to claim 1, wherein the widened cross-sectional areas each has a contour in the form of an equilateral triangle.

4. Apparatus according to one of claims 1, 2 or 3, wherein the substrate support is provided with a plurality of juxtaposed drains for the treatment liquid penetrating the skin.

5. Apparatus according to claims 4, wherein the net-like support and intermediate layer are formed of a fine-mesh.

6. Apparatus according to claim 5, wherein at least one of the underside of the treatment device and the widened cross-sectional areas have, in at least one extension direction, an extension corresponding to one of a width and length of the hide.

7. Apparatus according to claim 6, wherein the net-like support and the intermediate layer are constructed as conveyor belts arranged so as to receive the skin therebetween.

8. Apparatus according to claim 7, wherein the substrate support is constructed as a table adapted to be raised against the treatment device.

9. Apparatus according to claim 5, wherein spraying means are provided for cleaning the net-like support and the intermediate layer outside the treatment device.

10. Apparatus according to claim 9, wherein collecting container means are provided for receiving excess treatment liquid which has penetrated the skin and for enabling a recirculation of the liquid.

11. Apparatus according to claim 10, further comprising a large volume pressure vessel means for accommodating the treatment liquid, a first feed line means communicating the collecting container means with the pressure vessel means, and a second feed line means for feeding fresh treatment liquid from a storage container means.

12. Apparatus according to claim 11, wherein chemical-physical sensor means are arranged in at least one of the collecting container means and in the pressure vessel means, and wherein at least the second feed line means is controllable for maintaining predetermined concentrations and quantities in the pressure vessel means.

13. Apparatus according to claim 1, wherein the widened cross-sectional areas each has a contour in the form of a circle, and wherein at least one supply duct issues from a center of the circle.

14. Apparatus according to claim 1, wherein the widened cross-sectional areas each has a contour in the form of a square, and wherein at least one supply duct issues from a center of the square contour.

15. Apparatus according to claim 1, wherein the wet processes include at least one of liming, drenching, tanning, and dyeing.

16. Apparatus according to one of claims 17, 18 or 19, wherein the substrate support is provided with a plurality of juxtaposed drain means for enabling a draining of the treatment liquid penetrating the skin.

* * * * *